United States Patent [19]

Polko

[11] 4,269,341

[45] May 26, 1981

[54] STATIONERY BURSTER

[75] Inventor: Peter R. Polko, Palatine, Ill.

[73] Assignee: Uarco Incorporated, Barrington, Ill.

[21] Appl. No.: 91,336

[22] Filed: Nov. 5, 1979

[51] Int. Cl.[3] ..... B26F 3/02

[52] U.S. Cl. ..... 225/94; 225/100

[58] Field of Search ..... 225/100, 94; 226/74, 226/75; 270/52.5

[56] References Cited

U.S. PATENT DOCUMENTS

| | | | |
|---|---|---|---|
| 2,328,582 | 9/1943 | Ratchford et al. | 225/100 X |
| 3,161,335 | 12/1964 | Pine et al. | 225/100 |
| 3,484,031 | 12/1969 | Pine | 225/100 |
| 3,493,156 | 2/1970 | Absler et al. | 225/100 |
| 3,514,094 | 5/1970 | Absler et al. | 270/52.5 |
| 3,847,318 | 11/1974 | Parenti et al. | 225/100 |
| 3,856,196 | 12/1974 | Bayne et al. | 225/100 |
| 3,888,399 | 6/1975 | Hanson et al. | 225/100 X |
| 3,944,206 | 3/1976 | Bower | 270/52.5 |

*Primary Examiner*—Frank T. Yost

*Attorney, Agent, or Firm*—Wegner, Stellman, McCord, Wiles & Wood

[57] ABSTRACT

A stationery burster having substantially abutting, rotatably mounted, first and second infeed rolls, substantially abutting, rotatably mounted first and second outfeed rolls spaced from the infeed rolls along a path of stationery travel and a relief in the peripheral surface of the first infeed roll. A rotatable drive is provided for the second infeed and second outfeed rolls such that the peripheral speed of the second outfeed roll with be greater than that of the second infeed roll. The first rolls in each set are idler rolls. The spacing between the infeed and outfeed rolls may be adjusted to accommodate stationery of differing form lengths. A pinfeed tractor device for positively engaging stationery is located ahead of the infeed rolls and there is provided a drive for the tractor device such that the tractor device would drive stationery along the path of stationery travel at a speed in the range from just less to 10% less than the speed the stationery would travel along the path if positively advanced solely by the second infeed roll. A one-way clutch interconnects the tractor device and the tractor drive.

4 Claims, 2 Drawing Figures

FORM LENGTH ADJUSTMENT
IR
DR
W-28
2W

STATIONERY BURSTER

DESCRIPTION

Technical Field

This invention relates to stationery bursters, and more particularly to stationery bursters that are adjustable to accommodate stationery having varying form lengths, which bursters are of relatively small size.

BACKGROUND ART

In U.S. Pat. No. 3,484,031, issued Dec. 16, 1969 to Pine, there is disclosed a stationery burster which may be manufactured to be of relatively small size and which may be placed on a table or the like for use. The Pine burster is ideally suited for stationery processing operations which do not require large bursting capacity. The Pine burster is relatively uncomplicated in terms of moving parts and drive line complexities and is adjustable to accommodate continuous business form stationery of widely varying, conventional, form lengths, typically varying from 3½" up to 11", or more.

In the Pine burster, there is provided two sets of burster rolls, an infeed set and an outfeed set. Adjustment for varying form lengths is accomplished by varying the spacing between the two sets of rolls. The lower roll in each set is positively driven by a motor while the upper roll in each set is in idler relation to the respective lower roll and is accordingly driven thereby through frictional contact. Consequently, the roller surfaces wear and more often than not, the wear is not uniform from one end of a roll to the other. As a consequence, stationery passing along a path of stationery travel through the Pine burster, which stationery path includes roller sets, will tend to skew which in turn may interfere with proper separation of the form lengths and will frequently cause wrinkling to the extent of rendering the form unusable.

This tendency has heretofore prevented the use of trimmers in connection with the Pine burster. Trimmers are typically employed for removing margins from the continuous business form stationery and are set up at fixed locations along one or both sides of the stationery travel path. When skewing occurs, the forms tend to move to one side or the other of the stationery path with the consequence that if trimming were attempted, the line of trim, due to the fixed placement of the trimmer, would move inwardly or outwardly on the form, again rendering the form unusable.

The prior art such as depicted in U.S. Pat. No. 3,493,156, issued Feb. 3, 1970 to Absler, et al. has solved this difficulty through the use of tractor assemblies on the infeed end of a burster. Typically, the tractor assemblies will include some sort of movable means which move pins in the direction of stationery travel at the speed at which the stationery is to travel along the path. The pins positively engage the stationery by disposition in holes punched in the margins of the stationery, frequently termed control punch margins. Because of the expense of such tractor assemblies, they have heretofore been used substantially only in high capacity bursters wherein all of the burster rolls are positively driven in a precise timed arrangement such as that disclosed in U.S. Pat. No. 3,161,335, issued Dec. 15, 1964 to Pine, et al. The Pine, et al. burster is a relatively high capacity burster unlike the Pine burster and by reason of the positive driving of all burster rolls therein, is more expensive to fabricate than the Pine burster. Because all burster rolls in the Pine, et al. burster are positively driven, accommodation of a tractor unit can be readily made. When attempts have been made to place a tractor unit in a burster such as that of Pine wherein there is an idler burster roll in each set, and the drive speed of the tractor is set to be equal to that which would be applied to the stationery if positively engaged by the infeed rolls, it has been found that longer form lengths cannot be burst. Thus, the skewing problem encountered in relatively low capacity, relatively simple bursters is not susceptible to as easy a solution as merely applying a tractor to the infeed end of the burster in a conventional fashion.

DISCLOSURE OF THE INVENTION

The present invention is directed to overcoming one or more of the above problems.

The present invention represents an improvement in a relatively low capacity, low cost, simply constructed burster such as that disclosed in the previously identified Pine patent. It includes substantially abutting, rotatably mounted, first and second infeed rolls. There are also provided substantially abutting, rotatably mounted, first and second outfeed rolls which are spaced from the infeed rolls along a path of stationery travel. A relief is disposed on the peripheral surface of the first infeed roll and a rotatable drive for the second infeed and second outfeed rolls is provided such that the peripheral speed of the second outfeed roll will be greater than that of the second infeed roll and such that the first rolls will be idler rolls with respect to their respective second rolls. Means are provided for adjusting the spacing between the infeed rolls and the outfeed rolls to accommodate stationery of differing form lengths. The inventive improvement of the present invention includes the provision of a pinfeed tractor device for positively engaging stationery and which is located ahead of the infeed rolls along the path of stationery travel. A drive is provided for the tractor device such that the tractor device will drive the stationery along the path of travel at a speed in the range from just less to 10% less than the speed the stationery would travel along the path if positively advanced solely by the second infeed roll. The tractor device and the tractor drive are such that the tractor device can be pulled by stationery moving in the path at a speed greater than the tractor device speed range as set forth above.

As a result of this construction, it has been found that stationery of substantially all conventional form lengths and of widely varying paper weights can be successfully burst in an inexpensive burster without the stationery skewing.

Other objects and advantages will become apparent from the following specification taken in connection with the accompanying drawings.

BEST MODE FOR CARRYING OUT THE INVENTION

Figure 1:
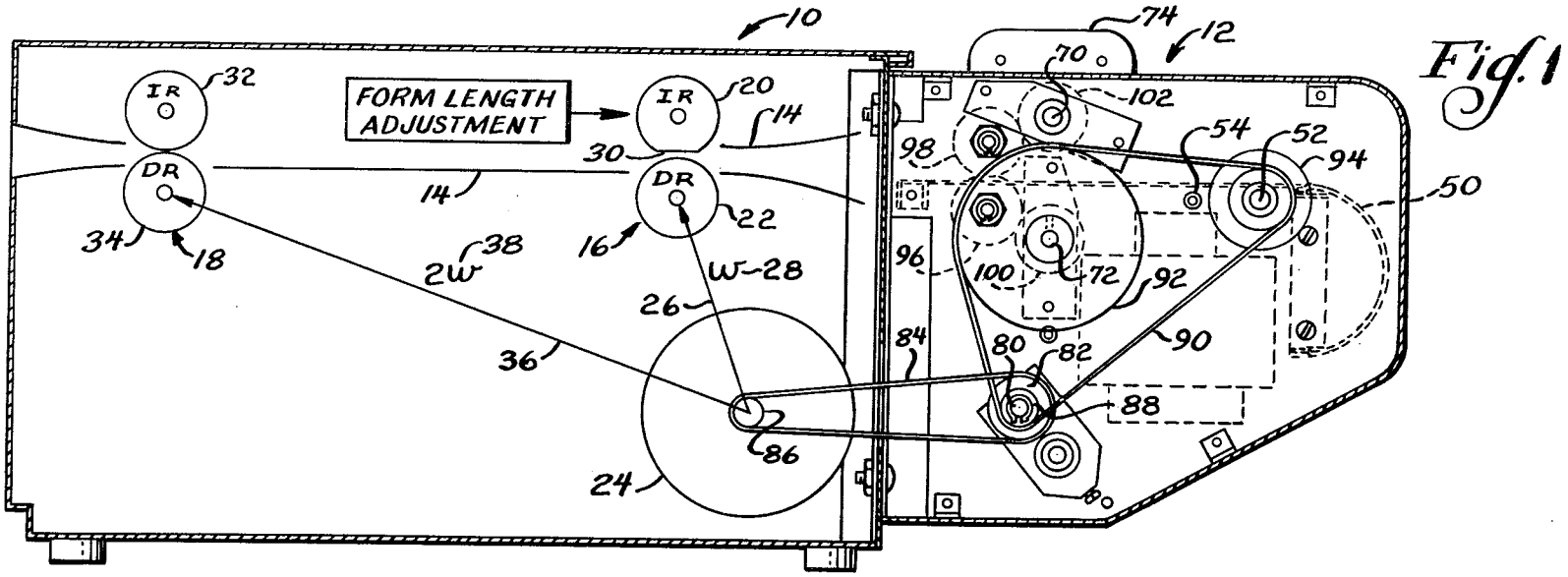
FIG. 1 is a side elevation of a burster made according to the invention with prior art components shown schematically.

An exemplary embodiment of a burster made according to the invention is illustrated in FIG. 1 and is seen to be formed of two basic parts. The first is a burster section, generally designated 10, which preferably is made according to the teaching of the previously identified Pine patent. The details of said Pine patent are therefore, herein incorporated by reference.

The second section is generally designated 12 and is a tractor trimmer section disposed on the infeed end of the burster 10.

The burster section 10 includes stationery guides 14 which guide stationery received from the tractor trimmer section 12 through a first pair of bursting rolls, generally designated 16, known as the infeed rolls. The guides 14 further guide the stationery to a pair of outfeed rolls, generally designated 18. Thus, the guides 14 essentially establish a path of stationery travel through the burster.

The infeed rolls 16 include an upper roll 20 and a lower roll 22. The lower roll 22 is positively driven by a motor 24 via a suitable mechanical connection shown schematically at 26 at a first angular velocity shown at 28. The upper roll 20 is in substantial abutment with the lower roll 22 and is driven thereby as a result of contact between the peripheral surfaces of the rolls. Thus, the upper roll 20 is, in effect, an idler roll. The same includes a relief 30 in its periphery for the purposes mentioned by Pine.

The outfeed rolls 18 include an upper, idler roll 32 and a lower, positively driven roll 34. The roll 34 is driven by the motor 24 via a mechanical connection shown schematically at 36, generally at an angular velocity considerably greater than that of the infeed driven roll 22. Frequently, where the rolls are of the same diameter, the outfeed driven roll 34 would be driven at twice the angular velocity of the driven infeed roll 22 as shown by the designation at 38. The precise ratios utilized will be dependent upon roll diameter, the essential characteristic being that the peripheral speed of the outfeed driven roller 34 be considerably greater than the peripheral speed of the infeed driven roller 22.

The upper outfeed roller 32 is driven by frictional contact with the driven outfeed roller 34. The manner in which continuous business form stationery is separated into individual form lengths along transverse lines of weakening by the burster section 10 is well known and need not be explained herein.

The tractor-trimmer section 12 includes a support surface 50 for stationery entering the apparatus. The support surface 50 defines a forward continuation of the path of stationery travel as also defined by the guides 14. A rotatable shaft 52 extends across the infeed end of the apparatus just below the surface 50. A guide shaft 54 is similarly disposed in space relation to the shaft 52.

Figure 2:
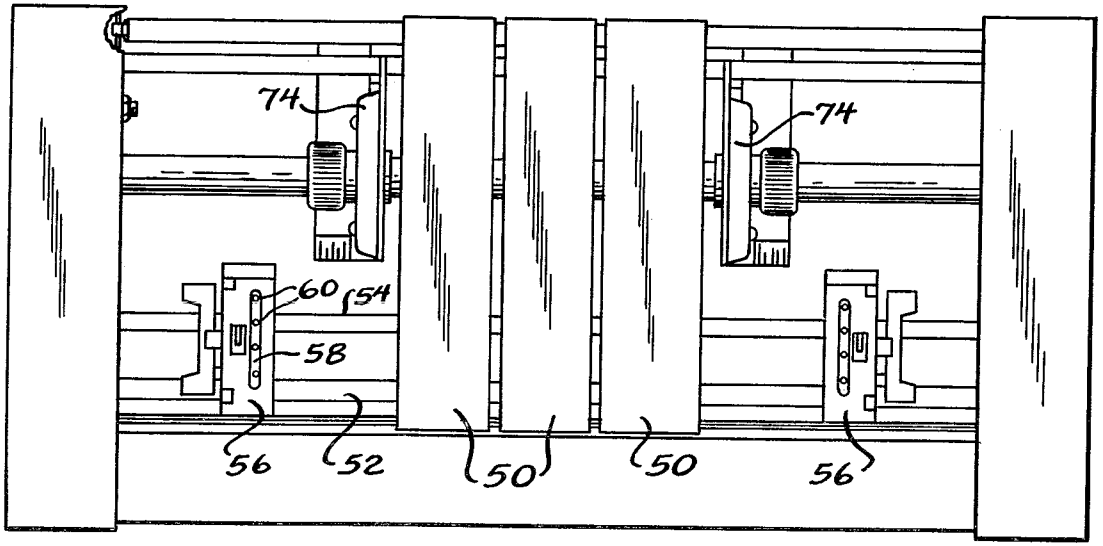
FIG. 2 is a plan view of a tractor and trimmer assembly utilized in the burster.

As seen in FIG. 2, the shafts 52 and 54 mount conventional pinfeed tractor assemblies 56. The tractors 56 slide along the shafts 52 and 54 toward and away from the support surface 50 so as to accommodate the apparatus for a variety of stationery widths.

Each tractor assembly includes a conventional, molded plastic belt 58 which in turn includes upstanding pins or projections 60, usually on half-inch centers, which are received in punched holes in the margins of the stationery to be processed. The belt 58 is trained about a drive sprocket (not shown) mounted on the shaft 52 and keyed thereto as well as an idler sprocket or sheave journalled on the shaft 54. Consequently, when the shaft 52 is driven by means to be described hereinafter, and the stationery has its control punch margins engaged with the pins 60 on one or both of the tractors 56, such stationery will be advanced along the path of travel, ultimately to the burster section 10.

Returning to FIG. 1, upper and lower shafts 70 and 72 are spaced about support surface 50 at a location intermediate the burster section 10 and the tractor devices 56. Both the shafts 70 and 72 are journalled for rotation and slidably mount a pair of trimmer assemblies 74 which may be of conventional construction and employed to trim stationery advanced along the path of its travel prior to its being burst. For example, the trimmers 74 may be utilized to trim the control punch margins from the stationery.

The tractor-trimmer section 12 journals a shaft 80 which has a first sheave 82 mounted thereon. A belt 84, which may be a timing belt, is trained about the sheave 82 and about a similar sheave 86 mounted on the output shaft of the motor 24. Consequently, when the motor 24 is energized, the sheave 82 and the shaft 80 will be rotatably driven. A sheave 88 is mounted on the shaft 80 for rotation therewith and a belt 90, which may be a timing belt, extends thereabout and is also trained about a sheave 92 mounted on the shaft 72 and the input side of a one-way clutch 94 of conventional construction mounted on the shaft 52.

Idler gears 96 and 98 are engaged respectively with gears 100 and 102 on the shaft 72 and 70 whereby rotation of the shaft 72 by the belt 90 is likewise conveyed to the shaft 70 to provide a drive for the trimmer assemblies 74.

The one-way clutch 94, for the configuration of the components shown in FIG. 1, is such that if the belt 90 were held stationary, the shaft 52 could be advanced in the counterclockwise direction but could not be moved in the clockwise direction.

Drive speed of the tractors 56 with respect to the peripheral speed of the driven infeed roller 22 is critical to achieve uniformly acceptable bursting over substantially all conventional form lengths of stationery formed of varying paper weights. It has been determined that the rate of drive that would be provided to stationery solely by the tractor 56 must be in the range from just less than to 10% less than the drive rate that would be provided to the stationery if positively driven by the driven infeed roller 22. If this speed range is deviated from, unacceptable bursting may occur for differing form lengths and differing paper weights. For example, if the tractor is driven at a rate less than the aforementioned range, bursting difficulties will occur in forms made of light paper weights such as paper of a 12 lb. weight or less. If the drive rate of the tractor is increased to be equal to that of the driven infeed roller 22, difficulty will be encountered in bursting forms having relatively long form lengths, regardless of paper weight employed. The following table sums up test results on various forms with various ratios of tractor drive rate to driven infeed roller drive rate. In the table, numerical values given in inches refer to form lengths in inches while the designations "Light" or "Heavy" refer to paper weights of 12 lbs. or less or 13 lbs. or more, respectively. Those forms characterized as "RAN WELL" never "jumped" the tractors, that is, did not lose positive engagement between their control punch margins and the tractor pins. Those forms characterized as "RAN POORLY" jumped the tractors approximately 50% of the time. Those forms characterized as "DID NOT RUN" always jumped the tractors.

| Tractor Paper Speed As A Percentage of The Driven Infeed Roller Speed | RAN WELL | RAN POORLY | DID NOT RUN |
|---|---|---|---|
| 62% | 3½" (Heavy) | 3½" (Light)<br>5½" (Heavy)<br>8½" (Heavy)<br>11" (Heavy) | 11" (Light) |
| 80% | 3½" (Heavy & Light)<br>5½" &<br>8½" (Heavy) | 11" (Heavy) | 11" (Light) |
| 98.7% | 3½"-11"<br>(All Weights) | — | — |
| 100% | 3½" & 5½"<br>(All Weights) | — | 8½" & 11"<br>(All Weights) |

In operation then, within the preferred speed ranges, it appears that the stationery is actually exerting a slight pulling force on the pins 60 by reason of it being drawn through the tractor mechanisms 56 by engagement with the driven infeed roll 22. To the extent that such occurs, it is accommodated by the presence of the clutch 94. It appears that the drive applied to the tractor from the motor 24 provides sufficient energy to overcome almost all of the friction in the tractor assemblies that would resist advancement of the stationery engaged with the pins 60. The results shown in the table above tend to bear this out in that as tractor drive speed is reduced with respect to driven infeed roller speed, there would, of course, be less energy applied to the tractor from the motor 24 thereby necessitating that the additional energy required be applied to the tractor by the forms from the driven infeed roller 22. This in turn tends to promote stationery jumping off of the tractors.

The reason for certain long length forms not bursting well when the preferred tractor speed range is exceeded is not fully understood. It is believed that a so-called "over-feeding" situation comes into existence causing the forms to jump the tractors. In other words, even though the tractor speed may be precisely equal to the peripheral speed of the driven infeed roller 22, the latter may not be advancing longer forms at a rate equal to its peripheral speed with the result that the tractor feeds the forms at a rate faster than they are received by the bursting section 10. The cause of this possible over-feeding is not known but it is suspected that it has to do with the presence of the relief 30 on the idler infeed roll 20 which cannot be omitted if bursting is to be achieved and/or roller wear resulting in a decrease in their circumference which in turn would cause a slight decrease in peripheral speed for a given rate of rotation of the motor 24. Alternately, the problem may occur as a result of normal manufacturing tolerances in that nominally identical driven infeed rollers 22 employed in two different bursters may not be quite the same size and would therefore generate different peripheral speeds even though identically driven.

In any event, the unique burster of the present invention eliminates paper handling problems such as skewing associated with low cost bursters employing untimed, idler rolls in the bursting section. The specified drive ratio for paper by the tractor versus the infeed drive roller provides good bursting for virtually all conventional form lengths utilized today without respect to the weight of paper of which the stationery is formed. The system automatically accommodates wear inherent in idler roller systems in that over-feeding cannot occur even after extended use, and thus wear, of the burster. Finally, provision of tractors provides a supplemental benefit in allowing the use of trimmers in low cost, untimed bursters for the first time.

I claim:

1. In a stationary burster having substantially abutting, rotatably mounted, first and second infeed rolls, substantially abutting, rotatably mounted, first and second outfeed rolls spaced from said infeed rolls along a path of stationery travel, a relief on the peripheral surface of said first infeed roll, a rotatable drive for the second infeed and second outfeed roll such that the peripheral speed of the second outfeed roll will be greater than that of the second infeed roll and said first rolls will be idler rolls with respect to their respective second rolls, and means for adjusting the spacing between said infeed rolls and said outfeed rolls to accommodate stationery of differing form lengths; the improvement comprising:

a pinfeed tractor device for positively engaging stationery and located ahead of said infeed rolls along said path of stationery travel, a drive for said tractor device such that said tractor device would drive stationery along said path at a speed in the range from just less to 10% less than the speed the stationery would travel along said path if positively advanced solely by said second infeed roll; and clutch means interconnecting said tractor device and said tractor drive.

2. In a stationery burster having substantially abutting, rotatably mounted, first and second infeed rolls, substantially abutting, rotatably mounted, first and second outfeed rolls spaced from said infeed rolls along a path of stationery travel, a relief on the peripheral surface of said first infeed roll, a rotatable drive for the second infeed and second outfeed roll such that the peripheral speed of the second outfeed roll will be greater than that of the second infeed roll and said first rolls will be idler rolls with respect to their respective second rolls, and means for adjusting the spacing between said infeed rolls and said outfeed rolls to accommodate stationery of differing form lengths; the improvement comprising:

a pinfeed tractor device for positively engaging stationery and located ahead of said infeed rolls along said path of stationery travel, a drive for said tractor device such that said tractor device would drive stationery along said path at a speed in the range from just less to 10% less than the speed the stationery would travel along said path if positively advanced solely by said second infeed roll; and a one way clutch interconnecting said tractor device and said tractor drive.

3. The burster of claim 2 further including a stationery trimmer along said path and disposed between said tractor device and said infeed rolls.

4. In a stationery burster having substantially abutting, rotatably mounted, first and second infeed rolls, substantially abutting, rotatably mounted, first and second outfeed rolls spaced from said infeed rolls along a path of stationery travel, a relief on the peripheral surface of said first infeed roll, a rotatable drive for the second infeed and second outfeed roll such that the peripheral speed of the second outfeed roll will be greater than that of the second infeed roll and said first rolls will be idler rolls with respect to their respective second rolls, and means for adjusting the spacing between said infeed rolls and said outfeed rolls to accommodate stationery of differing form lengths; the improvement comprising:

a pinfeed tractor device for positively engaging stationery and located ahead of said infeed rolls along said path of stationery travel, a drive for said tractor device such that said tractor device would drive stationery along said path at a speed in the range from just less to 10% less than the speed the stationery would travel along said path if positively advanced solely by said second infeed roll; said tractor device and said tractor drive being such that said tractor device can be pulled by stationery moving in said path at a speed greater than said tractor device speed range.

* * * * *